US010065055B2

(12) United States Patent
Larsen

(10) Patent No.: US 10,065,055 B2
(45) Date of Patent: Sep. 4, 2018

(54) MASK INCLUDING INTEGRATED SOUND CONDUCTION FOR ALERT NOTIFICATION IN HIGH-NOISE ENVIRONMENTS

(71) Applicant: Honeywell International Inc., Morristown, NJ (US)

(72) Inventor: Christopher Scott Larsen, Plymouth, MN (US)

(73) Assignee: Honeywell International Inc., Morris Plains, NJ (US)

( * ) Notice: Subject to any disclaimer, the term of this patent is extended or adjusted under 35 U.S.C. 154(b) by 578 days.

(21) Appl. No.: 14/039,380

(22) Filed: Sep. 27, 2013

(65) Prior Publication Data

US 2015/0090257 A1 Apr. 2, 2015

(51) Int. Cl.
*A62B 9/00* (2006.01)
*A62B 18/08* (2006.01)

(52) U.S. Cl.
CPC ..... *A62B 9/006* (2013.01); *A62B 18/08* (2013.01)

(58) Field of Classification Search
CPC ..... A61M 16/0087; A61M 16/009; A61M 16/0093; A61M 16/06; A61M 16/0605; A61M 16/0611; A61M 16/0616; A61M 16/0622; A61M 16/0627; A61M 16/0633; A61M 16/0638; A61M 16/0644; A61M 16/065; A61M 16/0655; A61M 2016/0661; A62B 7/00
See application file for complete search history.

(56) References Cited

U.S. PATENT DOCUMENTS 3,557,781 A * 1/1971 Kaye, Sr. ..... A61H 23/0263 601/71
5,404,577 A * 4/1995 Zuckerman ..... A42B 3/30 455/351
5,465,712 A * 11/1995 Malis ..... A61M 16/06 128/203.11
5,579,284 A * 11/1996 May ..... H04B 13/02 340/850
5,889,730 A 3/1999 May
(Continued)

FOREIGN PATENT DOCUMENTS

EP 1551242 B1 1/2012
WO WO-90/04908 A1 5/1990
WO WO 2004023914 A1 * 3/2004 ..... A42B 3/14

OTHER PUBLICATIONS

"Fire PTT with Bone Conduction Speaker Headset", [online]. © Voxtech. [retrieved on Aug. 23, 2013]. Retrieved from the Internet: <URL: http://www.voxtech.com/products.asp? MID:=69 &NID=265>, (2013), 6 pgs.
(Continued)

*Primary Examiner* — Rachel T Sippel
(74) *Attorney, Agent, or Firm* — Schwegman Lundberg & Woessner, P.A.

(57) ABSTRACT

A human wearable mask includes a skirt for directly contacting a human wearer and a sound conduction component on the skirt. The sound conduction component can provide an alert notification within high-noise environments while allowing ambient sounds to be heard over the conduction speakers. The sound conduction component may be used to reproduce audio for firefighters and other users who need radio communications.

20 Claims, 5 Drawing Sheets

(56) References Cited

U.S. PATENT DOCUMENTS

| | | | | |
|---|---|---|---|---|
| 7,040,319 | B1 * | 5/2006 | Kelly | A61M 16/0051 128/204.22 |
| 2003/0115010 | A1 * | 6/2003 | Estep | B63C 11/12 702/127 |
| 2004/0025880 | A1 * | 2/2004 | Capon | A62B 23/02 128/206.15 |
| 2004/0040561 | A1 * | 3/2004 | Tayebi | A62B 23/025 128/205.27 |
| 2009/0065007 | A1 * | 3/2009 | Wilkinson | A61M 16/0672 128/205.27 |
| 2010/0223706 | A1 * | 9/2010 | Becker | A42B 3/30 2/8.2 |
| 2010/0266140 | A1 * | 10/2010 | Fujino | H04M 1/605 381/92 |
| 2012/0055815 | A1 * | 3/2012 | Truex | A62B 9/006 206/205 |

OTHER PUBLICATIONS

"Half-face Masks", Divelink(r). [online]. [retrieved on Aug. 23, 2013]. [retrieved from the Internet: <URL: www.divelink.net/half-face.htm>, (2013), 1 pg.

"Radioear Bone Conduction Headsets Assisted by OLETC", [online]. [retrieved on Aug. 23, 2013]. Retrieved from the Internet: <URL: http://www.corrections.com/articles/9139>, (Sep. 12, 2003), 3 pgs.

Cai, Z., et al., "Response of Human Skull to Bone Conducted Sound in the Audiometric to Ultrasonic Range", Program in Biomedical Engineering. [online]. [archived on Feb. 25, 2006]. Retrieved from the Internet: <URL: http://www.tinnitus.vcu.edu/Pages/Human %20Skull%20Response.PDF>, (2006), 17 pgs.

* cited by examiner

MASK INCLUDING INTEGRATED SOUND CONDUCTION FOR ALERT NOTIFICATION IN HIGH-NOISE ENVIRONMENTS

FIELD OF THE INVENTION

The present disclosure relates to a mask. More particularly, the disclosure relates to a mask with a sound conduction component to provide an alert notification within high-noise environments.

BACKGROUND

First responders, soldiers, and other wearers often work in hazardous environments that require personal protective equipment (PPE). These hazardous environments may contain airborne contaminants that require respiratory protection. Some existing respirators include an End of Service Life Indicator (ESLI) to notify the users of the end of the useful life of the cartridge, where the cartridge life is the duration during which harmful gases do not exceed the permissible exposure limits at the user.

On Apr. 8, 1998, the Occupational Safety and Health Administration (OSHA) issued revised regulations for ESLI indicators. Specifically 29 C.F.R. 1910.134 requires the following: "For protection against gases and vapors, the employer shall provide: . . . An air-purifying respirator, provided that: The respirator is equipped with an end-of-service-life indicator (ESLI) certified by NIOSH for the contaminant; or If there is no ESLI appropriate for conditions in the employer's workplace, the employer implements a change schedule for canisters and cartridges that is based on objective information or data that will ensure that canisters and cartridges are changed before the end of their service life." If an ESLI is appropriate for the workplace conditions, the respirator must be equipped with an ESLI.

To indicate when a cartridge is nearing the end of its useful life, the ESLI must include a notification mechanism. However, an audible notification for ESLI, equipment failure, or a situational alarm (e.g. low air) may interfere with the user's ability to hear ambient noises. In the case of firefighting, the firefighter needs to be able to hear what is going on in the surrounding environment, and cannot afford to have an in-ear earpiece that interferes with the ambient sound. However, without an in-ear speaker, the alarms will be inaudible in loud environments. There is a tradeoff: in-ear speakers do not allow ambient awareness, out-of-ear speakers may not allow alarm awareness.

SUMMARY

A human wearable mask includes a skirt for directly contacting a human wearer and a sound conduction component on the skirt to provide an alert notification within high-noise environments.

DETAILED DESCRIPTION

Conduction speaker technology is integrated into a mask to vibrate a user's skull bone structure rendering equipment alarms audible in even the loudest ambient environments. The ambient sounds can also be heard over the conduction speakers. The conduction speakers may even be used for radio reception of audio for firefighters and other users who need radio communications.

Conduction speakers may vibrate one or more of the bones on the user's skull, including the forehead, cheekbone, or jawbone. Various protective equipment and breathing masks generally have access to this area, including Self-Contained Breathing Apparatus (SCBA), Self-Contained Underwater Breathing Apparatus (SCUBA), and respirator units. Conduction speakers may be used for alarm transmission, radio communications, or for other audio speaker functions.

In the following description, reference is made to the accompanying drawings that form a part hereof, and in which is shown by way of illustration specific embodiments that may be practiced. These embodiments are described in sufficient detail to enable those skilled in the art to practice the embodiments, and it is to be understood that other embodiments may be utilized and that structural, logical, and electrical changes may be made. The following description of example embodiments is, therefore, not to be taken in a limited sense, and the scope is defined by the appended claims.

The functions or algorithms described herein may be implemented in software or a combination of software and human implemented procedures in one embodiment. The software may consist of computer executable instructions stored on computer readable media such as memory or other type of storage devices. Further, such functions correspond to modules, which are software, hardware, firmware, or any combination thereof. Multiple functions may be performed in one or more modules as desired, and the embodiments described are merely examples. The software may be executed on a digital signal processor, application specific integrated circuit (ASIC), microprocessor, or other type of processor operating on a computer system, such as a personal computer, server, or other computer system.

Figure 1:
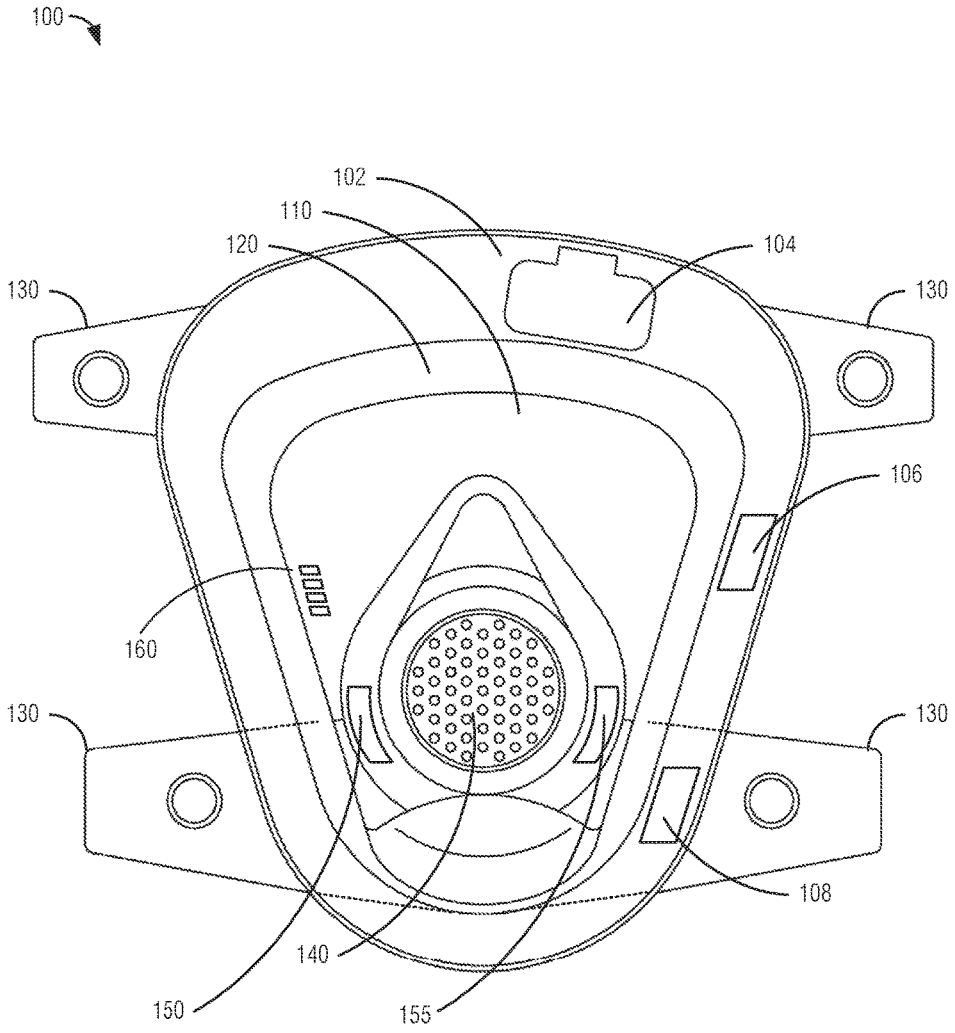
FIG. 1 illustrates a frontal view of a mask according to an example embodiment.

FIG. 1 illustrates a frontal view of a mask 100 according to an example embodiment. The mask 100 may have a skirt 102 that may include one or more conduction elements 104, 106, or 108. The conduction elements 104, 106, or 108 may be molded into or otherwise in contact with the skirt 102. The molding may include completely embedding (e.g., over-molding) the conduction elements 104, 106, or 108 into the skirt 102 to form a one-piece unit. The one-piece skirt 102 allows the embedded conduction elements 104, 106, or 108 to contact a skull bone of the user. For example, the forehead conduction element 104 may contact the frontal bone (i.e., forehead), the cheekbone conduction element 106 may contact the malar bone (i.e., cheekbone), or the jawbone conduction element 108 may contact the mandible (i.e., jawbone). Each conduction element 104, 106, or 108 may be covered by a vibration-conductive material (e.g., rigid plastic), where the vibration-conductive material contacts a skull bone of the user.

To ensure proper replacement of masks that include an integrated air purification module, the skirt 102 may include an ESLI detector and alarm that cannot be removed or serviced. A connector may be integrated into the mask for one or more of the conduction elements 104, 106, or 108. The connector may be useful in applications where integrated air purification module is replaceable, or in applications where an alarm is not to indicate the end of device life (e.g., recurring oxygen level alarms in SCUBA applications). The connector may enable a connection from one or more of the conduction elements 104, 106, or 108 to an ESLI or to a communications device. In some embodiments, one or more of the conduction elements 104, 106, or 108 may include a wireless receiver. The wireless receiver may be communicatively coupled to the ESLI or other communications device.

The skirt 102 may be formed using a flexible material such as silicone, and may be attached to the frame 120 along the entire perimeter of the frame 120 and the visor 110. The skirt 102 may form a substantially airtight seal with the face and forehead of the wearer that is important to prevent toxins from leaking into the space inside the mask 100 between the visor 110 and the wearer.

The mask 100 may have a substantially transparent visor 110 held in an airtight fashion by a frame 120. Straps 130 are fixed to the frame 120 and can be wrapped around the head of a wearer to hold the mask 100 in place. An exhalation valve 140 in the frame 120 allows the wearer to breathe and speak through the mask 100. Input conduits 150 and 155 may include one or more filters to filter incoming gas or may be attached to receive gas from a source of gas such as air or oxygen (not shown).

The mask 100 may have receptacles for respirator cartridges to provide passages for filtered air to a wearer of the mask 100. The respirator may include one or more respirator cartridges within the input conduits 150 and 155. An ESLI for a respirator cartridge may use an insert to provide samples from one or more points in the cartridge for the ESLI, where the samples may indicate when purifying media is nearing the end of its ability to filter air adequately. A respirator cartridge may include a container having an air-purifying element, such as a filter material for removing contaminants by adsorption, absorption, or chemisorption. For example, cartridge may be an organic vapor respirator cartridge, and may include activated charcoal or an air-purifying resin. As the cartridge is used, the filter material may remove gaseous contaminants and/or particulate matter contaminants from air that moves through the cartridge. Particulate matter may include various solid particles, liquid droplets, and/or organic contaminants such as bacteria, viruses, and the like. The particles are generally smaller than about one mm, about one hundred micrometers, about ten micrometers, or about one micrometer in diameter. Suitable purifying elements may be selected based on the contaminants to be removed from air to be breathed by a user. The filter material may not remove all contaminants, but in some embodiments, the filter material reduces at least one contaminant to acceptable levels. Note that exhaled air may leave the mask 100 through a one-way valve in the gas conduit 140, such that the exhaled air is not returned to the cartridges.

An optical indicator 160 may be included in the mask 100 and controlled by a controller to indicate when the respirator cartridges need replacing. The optical indicator 160 may be a light emitting diode (LED) or other visible indicator that may be controlled by control electronics. The control electronics may track cumulated use of the mask 100, and may provide battery monitoring. A battery may be mounted on a strap 130 to balance the weight of the respirator and not make the mask heavier than it needs to be. The control electronics may be located in several different positions, such as within the mask 100, or on clothing on the user. The control electronics may be powered, and by placing it on something separate from the cartridges, it may be easily reused for new cartridges. Control electronics may also be removeably placed on the cartridge in some embodiments, and have a self-contained power supply or connection to a power supply.

Figure 2:
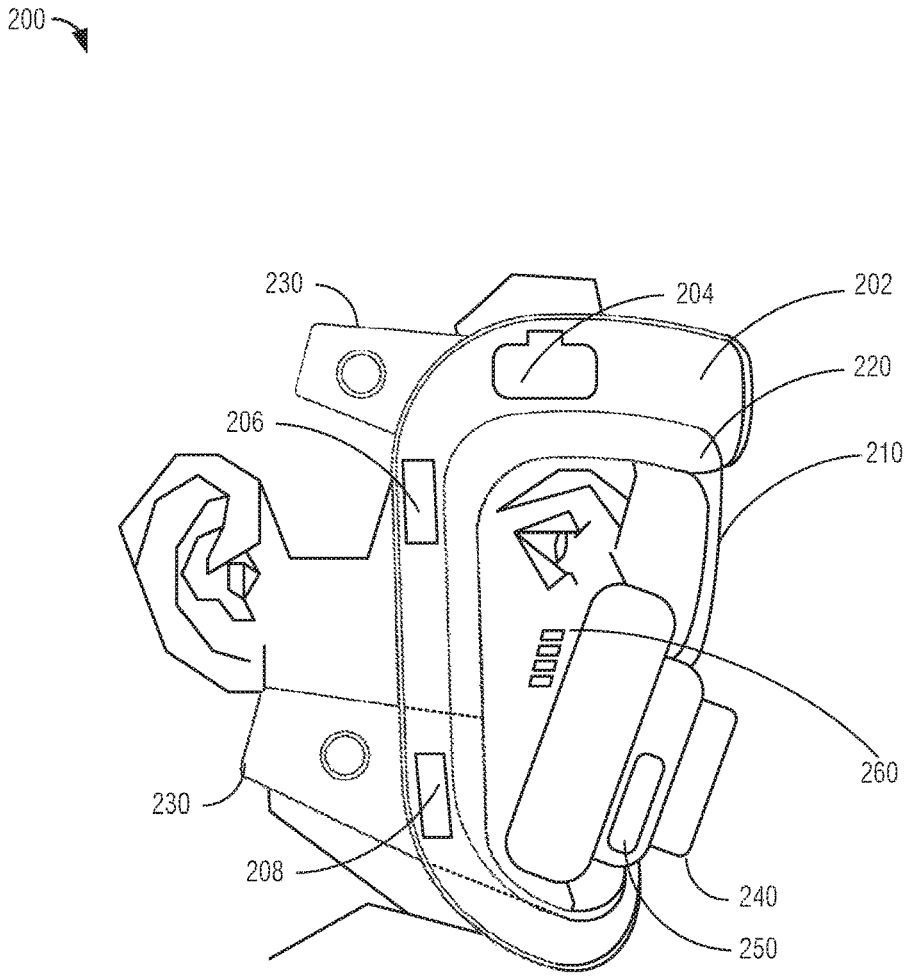
FIG. 2 illustrates a side view of a user-worn mask according to an example embodiment.

FIG. 2 illustrates a side view of a user-worn mask 200 according to an example embodiment. The mask 200 may have a skirt 202 that may include one or more conduction elements 204, 206, or 208, where the conduction elements 204, 206, or 208 may be arranged to contact a skull bone of the user. The mask 200 may have a substantially transparent visor 210 held in an airtight fashion by a frame 220. Straps 230 are fixed to the frame 220 and can be wrapped around the head of a wearer to hold the mask 200 in place. An exhalation valve 240 in the frame 220 allows the wearer to breathe and speak through the mask 200. The conduit 250 may include one or more filters within at least one input conduit 250 to filter incoming gas, or may be attached to receive gas from a source of gas such as air or oxygen (not shown). An optical indicator 260 may be included in the mask visor 210 to indicate when respirator cartridges or batteries need replacing.

Figure 3:
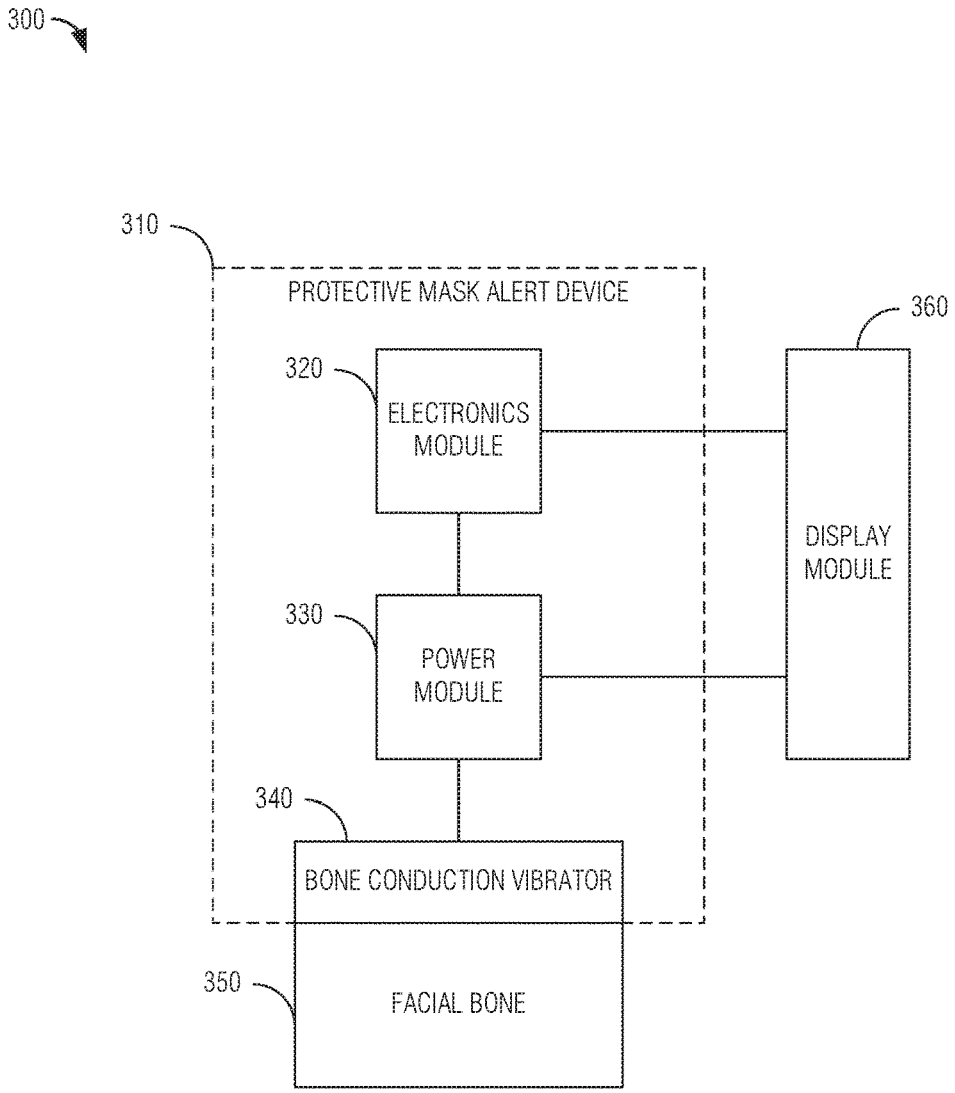
FIG. 3 is a block diagram of an example protective mask alert system according to an example embodiment.

FIG. 3 is a block diagram of an example protective mask alert system 300 according to an example embodiment. The protective mask alert system 300 may include a protective mask alert device 310. The protective mask alert device 310 may include an electronics module 320, a power module 330, and a bone conduction vibrator 340. The protective mask alert device 310 may be in contact with a skull bone 350 of a user, such as the forehead, cheekbone, or jawbone. To supplement the alert provided by the bone conduction vibrator 340, the protective mask alert device 310 may be connected to a display module 360. The display module 360 may be used to provide a redundant alert, to provide information about the protective mask alert device 310 (e.g., the power level of the power module 330), or may provide additional situational information (e.g., time, temperature, etc.).

Figure 4:
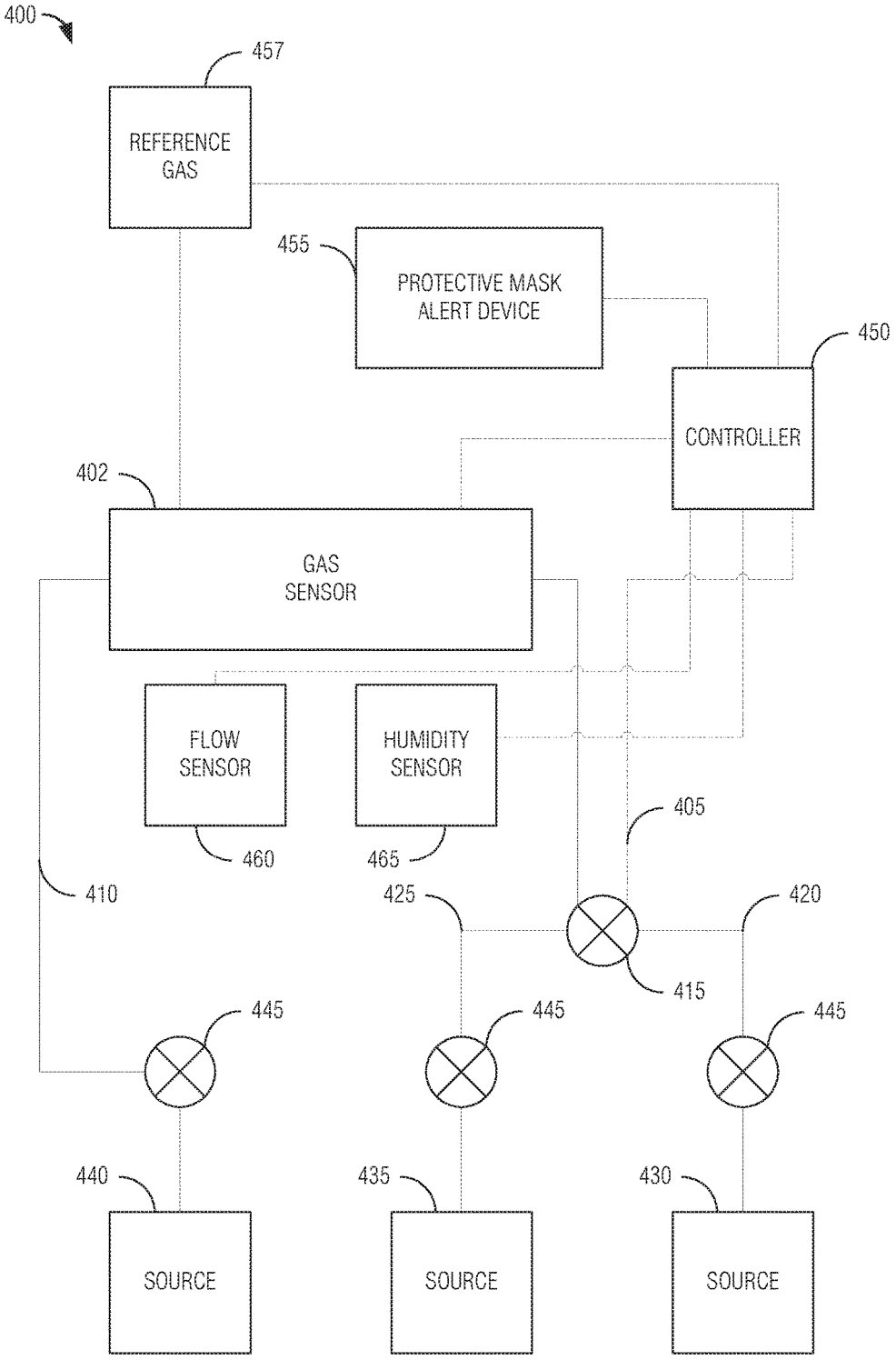
FIG. 4 is a block schematic representation of a gas-sensing and protective alert mask according to an example embodiment.

FIG. 4 is a block schematic representation of a gas-sensing and protective alert mask 400 according to an example embodiment. The mask 400 may include a controller 450 that may implement algorithms to determine the ESLI of the cartridge and may be coupled to a protective mask alert device 455 to provide a visible or audible warning to a user of a the mask 400.

The mask 400 may also have a gas sensor 402 having multiple paths for controlling or monitoring a sample gas. The controller 450 may be used to monitor or control a gas sensor 402 and a valve 415. Gas sensor 402 is illustrated with an input path 405 and an output path 410. In one embodiment, a valve 415 may be included in the input path 405 to select between two paths 420, 425. Each of the paths 410, 420, and 425 is coupled to an input source 430, 435, or 440 respectively. Additional valves 445 may be added in each individual source path 410, 420, and 425. In one embodiment a reference gas generator 457, such as a hydrogen generator is coupled to the gas sensor 402 to provide a reference gas to test or calibrate the sensor 402.

One of the sources may include a sensor to sense whether or not the mask is being used. If it is not being used, energy savings may be realized switching off or reducing power to the gas sensor, any heaters, or circuitry of the controller 450. The gas sensor 402 may be operated at a low power in one embodiment to operate as a flow sensor. When flow is detected, such as that caused by a user starting to breathe, the power may be restored. Alternatively, an input source 430, 435, or 440 may represent a physical switch to turn the gas mask on or off. In further embodiments, one or more sensors, such as a flow sensor 460 and a humidity sensor 465 may be used to provide further information to the controller 450. Information provided by the flow sensor 460 may be used to confirm that the gas channels are not clogged, or in power management of the gas sensor. In some embodiments, heater power of the gas sensor can be switched off when there is no flow for a longer time, such as when the mask wearer has removed the mask. While valve 415 is shown as a three way valve, it may also represent or be replaced by three two-way valves, with each valve in the legs 410, 425, and 420. Other configurations may be used to obtain desired flows within the legs for receiving and returning air to the insert, and controlling supply of a test gas as desired.

Figure 5:
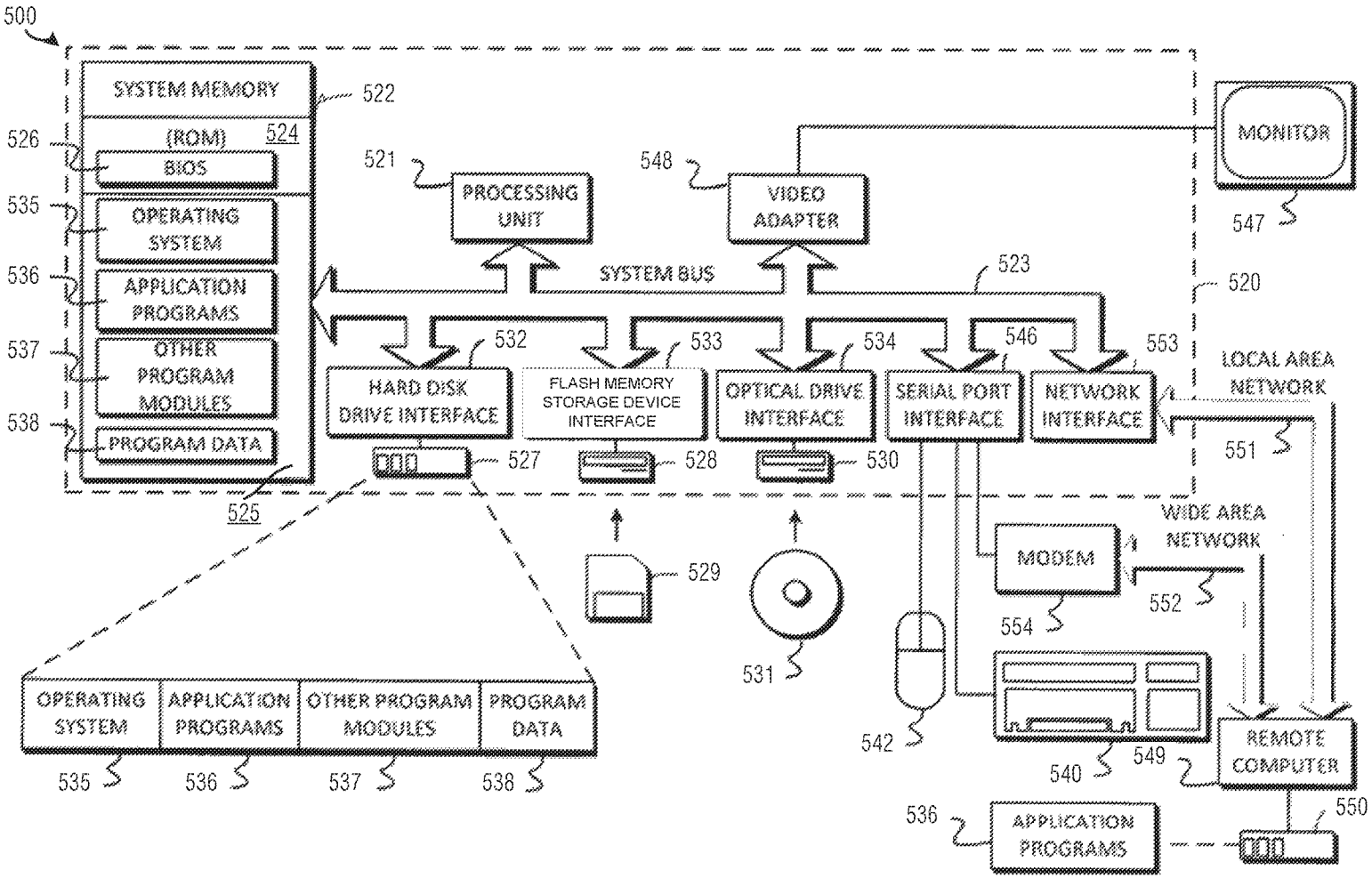
FIG. 5 is a block diagram of a computer system to analyze physiological data obtained from the integrated sensors according to an example embodiment.

FIG. 5 is a block diagram of a computer system 500 to analyze physiological data obtained from the integrated sensors according to an example embodiment. While several optional components are illustrated, many are not needed to perform the methods and functions described above, and may be omitted in various embodiments.

As shown in FIG. 5, one embodiment of the hardware and operating environment includes a general purpose computing device in the form of a computer 500 (e.g., a personal computer, workstation, or server), including one or more processing units 521, a system memory 522, and a system bus 523 that operatively couples various system components including the system memory 522 to the processing unit 521. There may be only one or there may be more than one processing unit 521, such that the processor of computer 500 comprises a single central-processing unit (CPU), or a plurality of processing units, commonly referred to as a multiprocessor or parallel-processor environment. In various embodiments, computer 500 is a conventional computer, a distributed computer, or any other type of computer.

The system bus 523 can be any of several types of bus structures including a memory bus or memory controller, a peripheral bus, and a local bus using any of a variety of bus architectures. The system memory can also be referred to as simply the memory, and, in some embodiments, includes read-only memory (ROM) 524 and random-access memory (RAM) 525. A basic input/output system (BIOS) program 526, containing the basic routines that help to transfer information between elements within the computer 500, such as during start-up, may be stored in ROM 524. The computer 500 further includes a hard disk drive 527 for reading from and writing to a hard disk, not shown, a magnetic disk drive 528 for reading from or writing to a removable magnetic disk 529, and an optical disk drive 530 for reading from or writing to a removable optical disk 531 such as a CD ROM or other optical media.

The hard disk drive 527, magnetic disk drive 528, and optical disk drive 530 couple with a hard disk drive interface 532, a magnetic disk drive interface 533, and an optical disk drive interface 534, respectively. The drives and their associated computer-readable media provide non-volatile storage of computer-readable instructions, data structures, program modules, and other data for the computer 500. It should be appreciated by those skilled in the art that any type of computer-readable media which can store data that is accessible by a computer, such as magnetic cassettes, flash memory cards, digital video disks, Bernoulli cartridges, random access memories (RAMs), read only memories (ROMs), redundant arrays of independent disks (e.g., RAID storage devices) and the like, can be used in the exemplary operating environment.

A plurality of program modules can be stored on the hard disk, magnetic disk 529, optical disk 531, ROM 524, or RAM 525, including an operating system 535, one or more application programs 536, other program modules 537, and program data 538. Programming for implementing one or more processes or methods described herein may be resident on any one or number of these computer-readable media.

A user may enter commands and information into computer 500 through input devices such as a keyboard 540 and pointing device 542. Other input devices (not shown) can include a microphone, joystick, game pad, satellite dish, scanner, or the like. These other input devices are often connected to the processing unit 521 through a serial port interface 546 that is coupled to the system bus 523, but can be connected by other interfaces, such as a parallel port, game port, or a universal serial bus (USB). A monitor 547 or other type of display device can also be connected to the system bus 523 via an interface, such as a video adapter 548. The monitor 547 can display a graphical user interface for the user. In addition to the monitor 547, computers typically include other peripheral output devices (not shown), such as speakers and printers.

The computer 500 may operate in a networked environment using logical connections to one or more remote computers or servers, such as remote computer 549. These logical connections are achieved by a communication device coupled to or a part of the computer 500; other types of communication devices may also be used. The remote computer 549 can be another computer, a server, a router, a network PC, a client, a peer device or other common network node, and typically includes many or all of the elements described above 110 relative to the computer 500, although only a memory storage device 550 has been illustrated. The logical connections depicted in FIG. 5 include a local area network (LAN) 551 and/or a wide area network (WAN) 552. Such networking environments are commonplace in office networks, enterprise-wide computer networks, intranets and the internet, which are all types of networks.

When used in a LAN-networking environment, the computer 500 is connected to the LAN 551 through a network interface or adapter 553, which is one type of communications device. In some embodiments, when used in a WAN-networking environment, the computer 500 typically includes a modem 554 (another type of communications device) or any other type of communications device, e.g., a wireless transceiver, for establishing communications over the wide-area network 552, such as the internet. The modem 554, which may be internal or external, is connected to the system bus 523 via the serial port interface 546. In a networked environment, program modules depicted relative to the computer 500 can be stored in the remote memory storage device 550 of remote computer, or server 549. It is appreciated that the network connections shown are exemplary and other means of, and communications devices for, establishing a communications link between the computers may be used including hybrid fiber-coax connections, T1-T3 lines, DSL's, OC-3 and/or OC-12, TCP/IP, microwave, wireless application protocol, and any other electronic media through any suitable switches, routers, outlets and power lines, as the same are known and understood by one of ordinary skill in the art.

EXAMPLES

1. A human wearable mask comprising a skirt for contacting a skull bone of a human wearer, the skirt including a vibration element in contact with the skirt, wherein the vibration element is positioned in contact with the skirt to conduct vibrations to the skull bone.

2. The human wearable mask of example 1, further including a vibration conductive material in contact with the skirt to conduct vibrations from the vibration element to the skull bone.

3. The human wearable mask of any of examples 1-2, further including a transducer to convert an electronic signal into a vibration signal.

4. The human wearable mask of any of examples 1-3, further including a wired connector communicatively coupled to the transducer to receive the electronic signal.

5. The human wearable mask of any of examples 1-4, further including a wireless receiver communicatively coupled to the transducer to receive the electronic signal.

6. The human wearable mask of any of examples 1-5, wherein the electronic signal indicates a level of breathable air remaining within a self contained breathing apparatus.

7. The human wearable mask of any of examples 1-6, wherein the electronic signal indicates a remaining duration of a respiratory protection service life.

8. The human wearable mask of any of examples 1-7, further including service life processing circuitry to determine the remaining duration of a respiratory protection service life.

9. The human wearable mask of any of examples 1-8, wherein the service life processing circuitry generates the electronic signal to indicate the remaining duration of a respiratory protection service life.

10. The human wearable mask of any of examples 1-9, further including a wireless transmitter communicatively coupled to the service life processing circuitry to transmit the electronic signal.

11. The human wearable mask of any of examples 1-10, wherein the human wearable mask is an air-purifying respirator.

12. The human wearable mask of any of examples 1-11, wherein the human wearable mask is a self-contained breathing apparatus mask.

13. The human wearable mask of any of examples 1-12, wherein the skirt is molded using silicone, and wherein the vibration element is molded within the skirt.

14. The human wearable mask of any of examples 1-13, wherein the skull bone is the jawbone, the cheekbone, or the forehead.

15. An alert notification mask comprising a transducer to convert an electronic alert signal into a vibration signal, a skirt for contacting a skull bone of a human wearer, the skirt including a vibration element in contact with the skirt, wherein the vibration element converts the vibration signal into a mechanical vibration, and wherein the vibration element is positioned in contact with the skirt to conduct the mechanical vibration to the skull bone, a display processing circuit to convert the electronic alert signal into an visual alert signal, a substantially transparent visor, and an optical display to display a visual representation of the visual alert signal within the field of view of the human wearer.

16. The alert notification mask of example 15, wherein the electronic alert signal indicates a remaining duration of a respiratory protection service life.

17. A method comprising obtaining an electrical signal representative of information to be communicated to a wearer of a mask, converting the electrical signal to vibrations, and transferring the vibrations to a skull bone of the wearer of the mask such that the information is audibly provided to the user via the vibrations of the skull bone.

18. The method of example 17, further including determining a remaining duration of a respiratory protection service life.

19. The method of any of examples 17-18, further including generating the electronic signal to indicate the duration of a respiratory protection service life.

20. The method of any of examples 17-19, further including displaying a visual representation of the electronic signal.

Embodiments described and claimed herein are not to be limited in scope by the specific embodiments herein disclosed, since these embodiments are intended as illustration of several aspects of the disclosure. Any equivalent embodiments are intended to be within the scope of this disclosure. Indeed, various modifications of the embodiments in addition to those shown and described herein will become apparent to those skilled in the art from the foregoing description. Such modifications are also intended to fall within the scope of the appended claims.

The invention claimed is:

1. A human wearable mask comprising:

a mask frame;

a skirt, attached along at least a portion of the perimeter of the mask frame, for contacting a skull bone of a human wearer, the skirt formed from a flexible material shaped to form a substantially airtight seal with the face and forehead of the human wearer, the skirt including a sound conductive vibration element over-molded within the skirt while maintaining the substantially airtight seal, the sound conductive vibration element adapted to be vibrationally coupled to the skull bone, wherein the sound conductive vibration element is positioned within the skirt and adapted to be positioned to contact the skull bone to conduct sound to the skull bone; and a set of straps fixed directly to the mask frame to hold the mask frame and skirt in place.

2. The human wearable mask of claim 1, wherein the sound conductive vibration element includes a rigid vibration conductive material adapted to be in contact with the skull bone to conduct vibrations from the sound conductive vibration element to the skull bone.

3. The human wearable mask of claim 1, wherein the sound conductive vibration element includes a transducer to convert an electronic signal into a vibration signal.

4. The human wearable mask of claim 3, further including a wired connector communicatively coupled to the transducer to receive the electronic signal.

5. The human wearable mask of claim 3, further including a wireless receiver communicatively coupled to the transducer to receive the electronic signal.

6. The human wearable mask of claim 3, wherein the electronic signal indicates a level of breathable air remaining within a self contained breathing apparatus.

7. The human wearable mask of claim 3, wherein the electronic signal indicates a remaining duration of a respiratory protection service life.

8. The human wearable mask of claim 7, further including service life processing circuitry to determine the remaining duration of a respiratory protection service life.

9. The human wearable mask of claim 8, further including a mask visor within the mask frame, wherein the service life processing circuitry displays a visual representation of the electronic signal on an optical indicator within the mask visor to indicate the remaining duration of a respiratory protection service life.

10. The human wearable mask of claim 9, further including a wireless transmitter communicatively coupled to the service life processing circuitry to transmit the electronic signal.

11. The human wearable mask of claim 1, wherein the human wearable mask is an air-purifying respirator.

12. The human wearable mask of claim 1, wherein the human wearable mask is a self-contained breathing apparatus mask.

13. The human wearable mask of claim 1, wherein the skirt is molded using silicone, and wherein the sound conductive vibration element is molded within the skirt.

14. The human wearable mask of claim 1, wherein the skull bone is the jawbone, the cheekbone, or the forehead.

15. An air purifying respirator comprising:

at least one air purifying cartridge;

an end of service life indicator to detect a cartridge end of service life and generate an electronic alert signal;

a mask frame;

a skirt, attached along at least a portion of the perimeter of the mask frame, for contacting a skull bone of a human wearer, the skirt formed from a flexible material shaped to form a substantially airtight seal with the face and forehead of the human wearer; and a transducer including a sound conductive vibration element over-molded within the skirt while maintaining the substantially airtight seal, the sound conductive vibration element adapted to be vibrationally coupled to the skull bone, the transducer communicatively coupled to the end of service life indicator to convert the electronic signal into a vibration signal, wherein the vibration element is positioned within the skirt and adapted to be positioned to contact the skull bone to conduct the vibration signal to the skull bone; and a set of straps fixed directly to the mask frame to hold the mask frame and skill in place.

16. The alert notification mask of claim 15, wherein the skirt is molded using silicone, and wherein the sound conductive vibration element is molded within the silicone skirt.

17. A method comprising:

obtaining an electrical signal representative of information to be communicated to a wearer of a mask;

converting the electrical signal to sound conductive vibrations; and transferring the sound conductive vibrations through a sound conductive vibration element adapted to be vibrationally coupled to a skull bone of the wearer of the mask such that the information is audibly provided to the user via the vibrations of the skull bone, wherein the sound conductive vibration element is over-molded within an airtight skirt while maintaining the substantially airtight seal, the sound conductive vibration element adapted to be positioned to contact the skull bone, the skirt attached along at least a portion of the perimeter of a mask frame, the skirt formed from a flexible material shaped to form a substantially airtight seal with the face and forehead of the human wearer.

18. The method of claim 17, further including determining a remaining duration of a respiratory protection service life.

19. The method of claim 18, further including generating the electronic signal to indicate the duration of a respiratory protection service life.

20. The method of claim 17, further including displaying a visual representation of the electronic signal on an optical indicator within a mask visor.

* * * * *